US005424000A

United States Patent [19]

Winicov et al.

[11] Patent Number: 5,424,000

[45] Date of Patent: Jun. 13, 1995

[54] ACID CLEANINGS AND STAINING COMPOSITIONS

[75] Inventors: Elsie L. Winicov, Kansas City, Mo.; Elizabeth L. Lenahan, Fairway; Michael W. Griffith, Kansas City, both of Kans.

[73] Assignee: West Agro, Inc., Kansas City, Mo.

[21] Appl. No.: 131,661

[22] Filed: Oct. 5, 1993

[51] Int. Cl.[6] ..... C11D 3/40; C11D 7/08; C11D 7/60

[52] U.S. Cl. ..... 252/151; 134/41; 134/42; 252/136; 252/142; 252/143; 252/146; 252/148; 252/149; 252/173; 252/539; 252/558

[58] Field of Search ..... 252/136, 151, 142, 143, 252/146, 148, 149, 173; 134/41, 42

[56] References Cited

U.S. PATENT DOCUMENTS

| | | | |
|---|---|---|---|
| 3,150,096 | 9/1964 | Schmidt et al. | 252/142 |
| 3,424,688 | 1/1969 | Boiko et al. | 252/142 |
| 4,204,978 | 5/1980 | Ibsen et al. | 252/408 |
| 4,589,925 | 5/1986 | Young | 134/3 |
| 4,776,974 | 10/1988 | Stanton et al. | 252/106 |

FOREIGN PATENT DOCUMENTS

| | | |
|---|---|---|
| 63-159758 | 7/1988 | Japan . |
| 9319152 | 9/1993 | WIPO . |

OTHER PUBLICATIONS

Chemical Abstracts accession No. 85:147910, for SU 517661, Jun. 15, 1976.

Derwent Abstracts accession No. 77-12340Y, for SU 517661, Jul. 8, 1976.

Chemical Abstracts accession No. 121:86262, for CN 1073710, Jun. 30, 1993.

Chemical Abstracts accession No. 93:9903, for Grig. Sanit. (1980), (4), 43-4 No Month available.

Talati et al., "Dyes as Corrosion Inhibitors . . . " in J. Electrochem. Soc. India (1986), 35(3), 175-181 No Month available.

Chemical Abstracts Registry file printout for RN#3244-80-0, 1994 No Month available.

Derwent accession No. 76-37007X/20, for JP 51038427, Mar. 31, 1976.

Derwent accession No. 77-51654Y/29, for SU 539058, Dec. 21, 1977.

Derwent accession No. 86-111960/17, for SU 1183049, Oct. 7, 1985.

Derwt. acc. No. 88-044056/07, for EP 255978, Feb. 17, 1988.

Derwt. acc. No. 91-182371/25, for JP3111401, May 13, 1991.

FOAMCHEK Label by West Agro, Inc., 1990 No Month available.

HI TEMP ACID 1000 Label by West Agro, Inc., Sep. 30, 1993.

Hi Temp Acid 2000 Label by West Agro, Inc., Sep. 30, 1993.

ACI-TEC Label by West Agro, Inc., 1992 No Month available.

Goldenberg et al.; Detection of Protein Deposition on Contact Lens Type Polymeric Hydrogels by Coomassie Blue R Staining; Biomaterials 1991, vol. 12 Apr.

Bickar et al.; A High-Affinity Protein Stain for Western Blots, Tissue Prints, and Electrophoretic Gels; Analytical Biochemistry 203, 109-155 (1992).

*Primary Examiner*—Christine Skane
*Assistant Examiner*—A. Hertzog
*Attorney, Agent, or Firm*—Hovey, Williams, Timmons & Collins

[57] ABSTRACT

Strong acid cleaning compositions supplemented with stable, protein-reactive staining dyes are provided which can be used for the acid clean-up of metallic food processing equipment while also giving a visual indication of residual soils on equipment surfaces. The compositions are provided as dilutable concentrates including water, a staining dye and at least about 5% by weight of a strong inorganic acid; the dye is stable in the concentrate under storage at 25° C. for at least about 3 months. The concentrates are diluted in water at the point of use and in such form have a pH of up to about 4. The preferred concentrates of the invention include water, from about 10%-50% by weight of an acid mixture comprising phosphoric, sulfuric and nitric acids, and Acid Violet 19 dye.

12 Claims, No Drawings

ACID CLEANINGS AND STAINING COMPOSITIONS

BACKGROUND OF THE INVENTION

1. Field of the Invention

The present invention is broadly concerned with dye-supplemented acidic surface cleaning concentrates having excellent long-term stabilities and which can be diluted for use in cleaning surfaces and to detect residual soils, especially proteinaceous soils on such surfaces. More particularly, the invention pertains to such concentrates and use solutions which are strongly acidic and useful for removing insoluble mineral deposits and other acid soluble films from food processing or other equipment, and, by virtue of the stable dye therein, simultaneously provide a visual indication of the effectiveness of the cleaning process. In practice, the solutions hereof may be used in the fashion of normal high acid surface cleaners, and also provide a desirable color indication if significant soil remains on the cleaned surfaces.

2. Description of the Prior Art

Food processors such as dairies regularly clean their processing equipment to insure the cleanliness thereof. In the case of dairies for example, the stainless steel and other metallic processing equipment is subject to the build-up of insoluble mineral deposits such as carbonates or "milk stone." Therefore, in order to prevent unsanitary conditions, dairies routinely clean their processing equipment in a multiple-step operation involving detergents, water softeners and alkalies, with a final clean-up using inorganic acid cleaning solutions. These acidic compositions are normally provided in the form of concentrates containing from about 10%–50% strong acid and are diluted on-site with from about 50–1,500 parts tap water to provide use solutions having a pH of up to about 4. The diluted use solutions are then passed through the processing equipment in order to properly clean the equipment.

Despite these stringent precautions, build-up of various proteinaceous and fat-containing soils on food processing equipment has been known to occur. This is a very serious problem indeed, and can lead to the production and sale of unsafe food products owing to contamination thereof by residual soils that may harbor bacteria on the processing equipment.

It would therefore be a decided advantage to provide, as a part of otherwise conventional acid clean-up concentrates and use solutions, a staining dye sensitive to proteinaceous soils, thereby allowing visual confirmation of whether or not the total clean-up has been successful.

SUMMARY OF THE INVENTION

The present invention overcomes the problems outlined above and provides a dilutable, concentrated acid cleaning composition containing water, a staining dye, and at least about 5% by weight of a strong inorganic acid selected from the group consisting of phosphoric, sulfuric and nitric acids and mixtures thereof, with the dye being stable in the concentrated composition under storage at 25° C. for at least about 3 months. Such a concentrate can be diluted with water to obtain an aqueous use composition operable to clean soiled surfaces and also detect the presence of residual soils thereon; such a dilute use composition would normally contain at least about 3 ppm of the staining dye, and sufficient acid to give the use composition a pH of up to about 4, and more preferably from about 2–3.

In preferred forms of the invention, the concentrate compositions contain from about 10%–50% by weight, and more preferably from about 20%–40% by weight of the strong acid. Desirably, the acid is present as a mixture of phosphoric, nitric and sulfuric acids, with phosphoric acid being present at a level in excess by weight as compared with the other acids of the mixture.

As indicated, the staining dye should be stable in the concentrate composition under storage at 25° C. for at least about 3 months, and more preferably for about 6 months or more. As used herein, staining dye stability in the acid concentrates hereof refers to: (1) the ability of the staining dye to remain properly dispersed during the storage period in question; and (2) the ability of the dye to retain at least about 60% of its initial coloration intensity during the period. Retention of coloration intensity is determined by initially measuring the peak (i.e., maximum absorption) spectrophotometric absorption of the concentrate immediately after preparation thereof, thereafter measuring a comparative peak spectrophotometric absorption at the same peak absorption wavelength initially used, and determining the percentage of coloration intensity retained based upon the initial peak absorption value.

In order to meet the stability criteria of the present invention, a candidate staining dye must be essentially soluble in strong acid solution. Preferably, the staining dyes employed are sulfonated triphenylmethane dyes, and particularly Acid Violet 19 (benzenesulfonic acid, 2-amino-5-[(4-amino-3-sulfophenyl)(4-imino-3-sulfo-2,5-cyclohexadien-1-ylidine)methyl]-3-methyl-,disodium salt).

Generally, the staining dye should be present in the concentrate compositions at a level of from about 0.03%–5% by weight, and more preferably from about 0.1%–1% by weight. The concentrates may also contain a minor amount of urea therein (usually from about 0.01%–0.5% by weight), particularly when nitric acid is used, in order to react with any residual nitric oxides. Also, the concentrates could contain very small amounts of conventional corrosion inhibitors.

The diluted use compositions of the invention preferably contain from about 5 ppm–100 ppm of the staining dye, and more preferably from about 10 ppm–50 ppm thereof. The strong acid should be present at a level of at least about 0.05% by weight, and more preferably from about 0.1%–0.3% by weight.

In use, the diluted compositions of the invention are employed to remove soils from surfaces, and especially metallic surfaces. In this manner, the use solutions are contacted with the surfaces and the staining dye therein provides a visual indication of any remaining proteinaceous soils. Normally, the contact period between the surface to be cleaned and the use compositions hereof should be at least about 1 minute, and more preferably from about 1–60 minutes.

DETAILED DESCRIPTION OF THE PREFERRED EMBODIMENTS

The most preferred concentrate compositions of the present invention include as the staining dye component Acid Violet 19, Color Index 42685. This dye is available from several commercial sources and is a member of the triphenylmethane family. The dye is very soluble in acid solutions and concentrations of more than 5% by weight dye can be prepared; however, such high concentrations are not ordinarily considered necessary, since much lower concentrations will be effective in staining soils, even when the concentrates are diluted with 50–500 or even higher parts of water per part of concentrate.

Ordinarily, in the preferred concentrate compositions, the strong acid will be present at a level of from about 10%–50% by weight. The higher acid limit is dictated primarily by corrosiveness and safety considerations, while the lower limit is based upon packaging and shipping considerations. There are no problems in principle in providing staining dyes wherein the acid fraction is less than about 10% by weight. Nitric Acid is preferably a part of the concentrates, owing to the fact that nitric acid imparts a brightness to stainless steel commonly found in food processing equipment. A drawback of nitric acid is that it can contain small amounts of byproduct nitric oxides which can rapidly oxidize organic materials including the staining dye. In order to overcome this potential problem, the oxides can be removed by bubbling air through the nitric acid, or by adding either a small amount of hydrogen peroxide or urea to the final concentrate. Finally, a small amount usually less than 0.1% of a conventional corrosion inhibitor may be added to the concentrates.

It is also within the ambit of the invention to incorporate small amounts of weak carboxylic acids into the concentrates and the ultimate use compositions. Surfactants, viscosity modifiers and odoriferous additives may also be used if desired.

The following Examples set forth certain preferred concentrates and use compositions in accordance with the invention. It is to be understood, however, that these examples are presented by way of illustration only and nothing therein should be taken as a limitation upon the overall scope of the invention.

EXAMPLE 1

In this Example, a series of strongly acidic dye compositions were prepared, differing only in that each composition contained a different dye present at a level of 0.2% by weight. These dyes were selected based upon an evaluation of their abilities to stain protein films, or from literature suggesting their use in other formulations as stain indicators. Each of the compositions was evaluated for homogeneity at the time of preparation, and a peak (i.e., maximum absorption) spectrophotometric absorption of each sample was determined at this time. The absorption value obtained for each sample was recorded as the 100% value. At subsequent time intervals, new comparative spectrophotometric absorptions of each sample were taken at the same peak absorption wavelengths as the initial determinations, and the absorption values were recorded as a percentage of the original 100% value. Each of the compositions was made up of the following ingredients:

TABLE 1

| Ingredient | % W/W |
|---|---|
| Dye | 0.20 |
| Phosphoric Acid (100% Basis) | 18.75 |
| Nitric Acid (100% Basis) | 9.0 |
| Sulfuric Acid (100% Basis) | 4.0 |
| Urea | 0.1 |
| Amine Corrosion Inhibitor | 0.04 |
| Water | q.s. to 100% |

The dyes employed in each of the test compositions of this Example are set forth below along with their respective Color Index (C.I.) numbers. The C.I. number corresponding to the particular chemical identity is published by the American Association of Textile Chemists and Colorists, Research Triangle Park, North Carolina, and is incorporated by reference herein.

TABLE 2

| Sample | Name | C.I. Number |
|---|---|---|
| A | Methylene Blue | 52015 |
| B | Crystal Violet | 42555 |
| C | Methyl Violet | 42535 |
| D | FD&C Green #3 | 42053 |
| E | Coomassie Brilliant Blue | 42660 |
| F | Eosin Y | 45380 |
| G | Ponceau S | 27195 |
| H | Amide Black 10B | 20170 |
| I | Acid Crimson | 14895 |
| J | Acid Violet 19 | 42685 |
| K | Acid Black 1 | 20470 |
| M | Remazol Brilliant Blue R | 61200 |
| N | Crystal Violet | 42555 |
| O | FD&C Blue #1 | 42090 |

During initial preparation of the samples set forth above, some of the dyes did not dissolve properly and left extensive insoluble residues, either immediately or after a few weeks storage time. These samples were B, C, E, F, G, H, I, K, M and N, and because of these failures were not evaluated further for color stability. The remaining samples were stored in glass bottles at room temperature and 50° C., the latter being an accelerated stability study. The dye stabilities were evaluated periodically by peak level spectrophotometric absorption, as explained above.

The following table sets forth the results of this evaluation.

TABLE 3

| % Color Remaining | A | D | J | O |
|---|---|---|---|---|
| 2 weeks, RT | 50–60% | 15–20% | 90–100% | <20% |
| 2 weeks, 50° C. | 20–30% | 0 | 90–100% | 0 |

These results demonstrate the outstanding stability of the preferred dye, Acid Violet 19 (Sample J).

EXAMPLE 2

A second series of experiments was conducted using different levels of the preferred Acid Violet 19 dye in a mixture of three acids. The ingredients of these test compositions P-S are set forth below.

TABLE 4

| Ingredients | P | Q | R | S |
|---|---|---|---|---|
| Acid Violet 19 | 0.10% | 0.20% | 0.50% | 1% |
| Phosphoric Acid (100% Basis) | 19% | 19% | 19% | 19% |
| Nitric Acid (100% Basis) | 8% | 8% | 8% | 8% |
| Sulfuric Acid (100% Basis) | 4% | 4% | 4% | 4% |
| Urea | 0.10% | 0.10% | 0.10% | 0.10% |
| Amine Corrosion Inhibitor | 0.04% | 0.04% | 0.04% | 0.04% |
| Water | q.s. 100% | q.s. 100% | q.s. 100% | q.s. 100% |

All of the compositions P-S were completely homogeneous, and all exhibited excellent dye intensity stability with substantially no loss of coloration (i.e., 90–100% retention of the original peak level spectrophotometric absorption readings) after three months storage at a mean temperature of 25° C. All of the compositions gave satisfactory dye stability when stored in direct sunlight. Acid Violet 19 was found to be very soluble in strong acid solutions; more than 5% of this dye can be solubilized in the above acid mixture with no apparent problems.

EXAMPLE 3

The protein staining ability of the Acid Violet 19 compositions of Example 2 were evaluated by exposing milk-stained 304 stainless steel coupons to aqueous solutions of the compositions with varying levels of dye. The coupons measured 1"×3"×1/32" and were dipped in milk and allowed to air dry for 12–24 hours. A barely visible whitish discoloration could be noticed when the coupons were examined. A series of dilutions of the compositions P-S were prepared, and the soiled coupons were placed in these dilutions so that 50–75% of the soiled area was covered by the respective acid staining solution dilution. The coupons were removed at varying time intervals and visually evaluated as to the amount of dye absorbed onto the milk soil, indicating the presence of the soil on the metal surface. The pink coloration was found to vary from very light but noticeable to very bright (i.e., more than necessary to achieve a ready visual indication of protein soiling).

The individual dilutions, exposure times and coloration results are set forth below.

TABLE 5

| Composition | Aqueous Dilution | Dye Concentration | Exposure Time | Coloration |
|---|---|---|---|---|
| S | 1:100 | 100 ppm | 5 min. | Brightest |
| S | 1:100 | 100 ppm | 1 min. | Very Bright |
| R | 1:100 | 50 ppm | 5 min. | Bright |
| R | 1:200 | 25 ppm | 5 min. | Strong |
| Q | 1:100 | 20 ppm | 5 min. | Strong |
| Q | 1:200 | 10 ppm | 5 min. | Light |
| P | 1:100 | 10 ppm | 5 min. | Light |
| P | 1:100 | 10 ppm | 60 min. | Light/Strong |
| P | 1:200 | 5 ppm | 60 min. | Very Light |

The above results demonstrate that as little as 5 ppm of dye in a use solution can function as a soil indicator under the above conditions, and that a concentration in the range of from about 20–100 ppm gives very good staining ability even with very short exposure times. In this regard, it should be understood that the optimum efficient amount of dye to be incorporated into an acid mixture will depend upon final intended use for a particular soil condition and exposure time. Given an exposure time of several hours, for example, as little as 3 ppm dye has given trace coloration, when the surface was viewed under good lighting conditions.

We claim:

1. A dilutable, concentrated, acidic cleaning composition for dilution and use in the removal of soils from surfaces and detection of proteinaceous soil residues on said surfaces, said composition comprising water, from about 0.1–1% by weight of a protein-reactive staining dye, and from about 20–40% by weight of an acid selected from the group consisting of phosphoric, sulfuric and nitric acids and mixtures thereof, said dye being stable in said composition under storage at 25° C. for at least about 3 months, the percentage by weight of water being greater than the percentage by weight of acid in said composition.

2. The composition of claim 1, said acid being a mixture of phosphoric, nitric and sulfuric acids.

3. The composition of claim 1, said dye being stable under storage at 25° C. for at least about 6 months.

4. The composition of claim 1, including a minor amount of urea therein.

5. The composition of claim 1, said dye comprising a sulfonated triphenylmethane dye.

6. The composition of claim 5, said dye being Acid Violet 19.

7. The composition of claim 1, said acid comprising a mixture of acids including phosphoric acid, said phosphoric acid being present at a level in excess by weight as compared with the other acids of said mixture.

8. The composition of claim 1, when diluted in water to a 1:100 composition:water level, having a pH of up to about 4.

9. The composition of claim 8, said pH being from about 2–3.

10. A dilutable, concentrated, acidic cleaning composition for dilution and use in the removal of soils from surfaces and detection of proteinaceous soil residues on said surfaces, said composition comprising water, from about 0.1–1% by weight of a protein-reactive staining dye, and from about 10–50% by weight of a mixture of phosphoric, sulfuric and nitric acids, said dye being stable in said composition under storage at 25° C. for at least about 3 months.

11. A dilutable, concentrated, acidic cleaning composition for dilution and use in the removal of soils from surfaces and detection of proteinaceous soil residues on said surfaces, said composition comprising water, from about 0.1–1% by weight of a protein-reactive staining dye, from about 10–50% by weight of an acid selected from the group consisting of phosphoric, sulfuric and nitric acids and mixtures thereof, and a minor amount of urea, said dye being stable in said composition under storage at 25° C. for at least about 3 months.

12. A dilutable, concentrated, acidic cleaning composition for dilution and use in the removal of soils from surfaces and detection of proteinaceous soil residues on said surfaces, said composition comprising water, from about 0.1–1% by weight of a protein-reactive staining dye, and from about 10–50% by weight of a mixture of acids including phosphoric, sulfuric and nitric acids, said phosphoric acid being present at a level in excess by weight as compared with the other acids of said mixture, said dye being stable in said composition under storage at 25° C. for at least about 3 months.

* * * * *